United States Patent [19]

Anderson et al.

[11] 4,162,809

[45] Jul. 31, 1979

[54] OSCILLATING CARPET AND TILE STRIPPER

[76] Inventors: Lloyd E. Anderson, 6408 74th Ave. N., Brooklyn Park, Minn. 55429; Gilbert L. Alinder, 17029 Fiesta Ct., Sun City, Ariz. 85351

[21] Appl. No.: 875,226

[22] Filed: Feb. 6, 1978

[51] Int. Cl.[2] ..... A47L 11/12

[52] U.S. Cl. ..... 299/37; 15/93 R

[58] Field of Search ..... 299/37; 15/93 R; 30/169, 170; 172/20, 19

[56] References Cited

U.S. PATENT DOCUMENTS

| | | | |
|---|---|---|---|
| 1,979,554 | 11/1934 | Huntington | 299/37 |
| 2,245,544 | 6/1941 | Miller | 299/37 |
| 2,874,946 | 2/1959 | Singleterry et al. | 299/37 |
| 3,195,232 | 7/1965 | Toth | 30/169 |
| 3,779,605 | 12/1973 | Nieman | 299/37 |
| 4,009,908 | 3/1977 | Alinder et al. | 299/37 |

*Primary Examiner*—Ernest R. Purser
*Attorney, Agent, or Firm*—Schroeder Siegfried Ryan Vidas & Steffey

[57] ABSTRACT

This invention relates to an oscillating carpet and tile stripper in which the cutting blade is mounted on a mounting and drive assembly which is connected to an eccentric driven by an electric motor to impart an orbital motion to the cutting blade. The end of the drive bar assembly adjacent the cutting blade is guided in translatory movement such that the movement of the cutting blade is at an angle to the frame and is slightly restricted in a transverse direction. This will decrease the effect of centrifugal force of the blade in the transverse direction of movement of the cutting blade without change of the amount of eccentricity of the eccentric to minimize vibration on the machine. The blade operates at a high rate of speed to provide a shearing action at the blade tip which rapidly removes bonded carpet or tile from a floor.

14 Claims, 5 Drawing Figures

10
12
13
14
17
30
31
32
33
35
36
37
38
39
40
41
42
46
48
49
50
52
54
56
57
58
59
60
61
62
63
64
66
70
72
77
80
83
4
5

OSCILLATING CARPET AND TILE STRIPPER

FIELD AND BACKGROUND OF INVENTION

This invention is directed to a carpet and tile stripping machine and more particularly to an improved machine of this type having an oscillatory cutting and stripping action which enables a single operator to remove carpet or tile that is bonded to a floor.

Machines of this type have accomplished their stripping or cutting action through the use of reciprocating motion of blade members perpendicular to a cutting edge. Examples of such machines are shown in the U.S. Pat. Nos. to Cawley 3,251,629 and Becker 2,906,514. Such machines have been ineffective to positively clean a floor of carpet or tile material bonded thereto because the cutting motion is reciprocating rather than a shearing type. In our prior application for a Carpet and Tile Stripper, now U.S. Pat. No. 4,009,908, dated Mar. 1, 1977, the cutting blade is driven through an oscillating member so that the blade pivots about a shaft in axial alignment with the travel of the carpet stripper. While this structure provides a relatively wide range of pivoting of the blade about a center point, the shearing action is not uniform because of the lack of movement at the center of the blade.

Floor covering strippers have been made utilizing a pure eccentric action to drive a cutting blade in an oscillating manner. The U.S. Pat. No. to Singleterry et al 2,874,946 is an example. However, with such an arrangement, the journaling of the oscillating cutting blade and the degree of eccentricity of the drive to create the oscillation present certain disadvantages. If the eccentricity is increased to increase the path of blade movement, the vibration is increased and a turning movement results due to the action of centrifugal force on the machine which results in difficulty in operating the machine and the possibility of damage to the machine. Further, if the oscillating part is not journaled, the machine is subject to extreme wear.

SUMMARY OF THE INVENTION

The present invention constitutes an improvement over reciprocating blade type actions and oscillating actions of the stripping blade in carpet and tile stripping machines in its use of an orbital type of journaled movement of the stripping blade to provide for uniform shearing action in a stripping operation. It is also an improvement over prior orbital and oscillating type carpet strippers in that the stripping blade is mounted at an angle to the support frame opposite to the direction of rotation of the drive motor to offset the effect of centrifugal force on the frame and blade mounting assembly. This results in ease in operation of the machine and reduces vibration of the frame of the machine. The cutting or stripping blade is angled so as to bear against the floor with the blade edge traveling through an orbital path in a substantially horizontal plane. With the offset of the blade, a slight decrease in range in the transverse direction is provided for a given reciprocating movement to further reduce vibration. This oscillating motion produces a shearing action which rapidly and efficiently lifts the carpet material or tile type material from a floor leaving a minimum of residue thereon. the transverse movement of the blade is restricted slightly by connecting the front end of an elongated drive bar to a link pivoted on the frame. This connection also sets the angle of the blade mounting assembly with respect to the support frame to reduce the turning movement of the machine caused by centrifugal force. Thus, it is easier to hold and operate in a stripping operation. The improved machine utilizes a cutting blade mounting assembly which is effectively journaled and guided in the supporting frame for a minimum of wear of parts and maintenance of the machine.

The invention will be best understood in connection with the following drawings wherein:

DESCRIPTION OF PREFERRED EMBODIMENT

Figure 1:
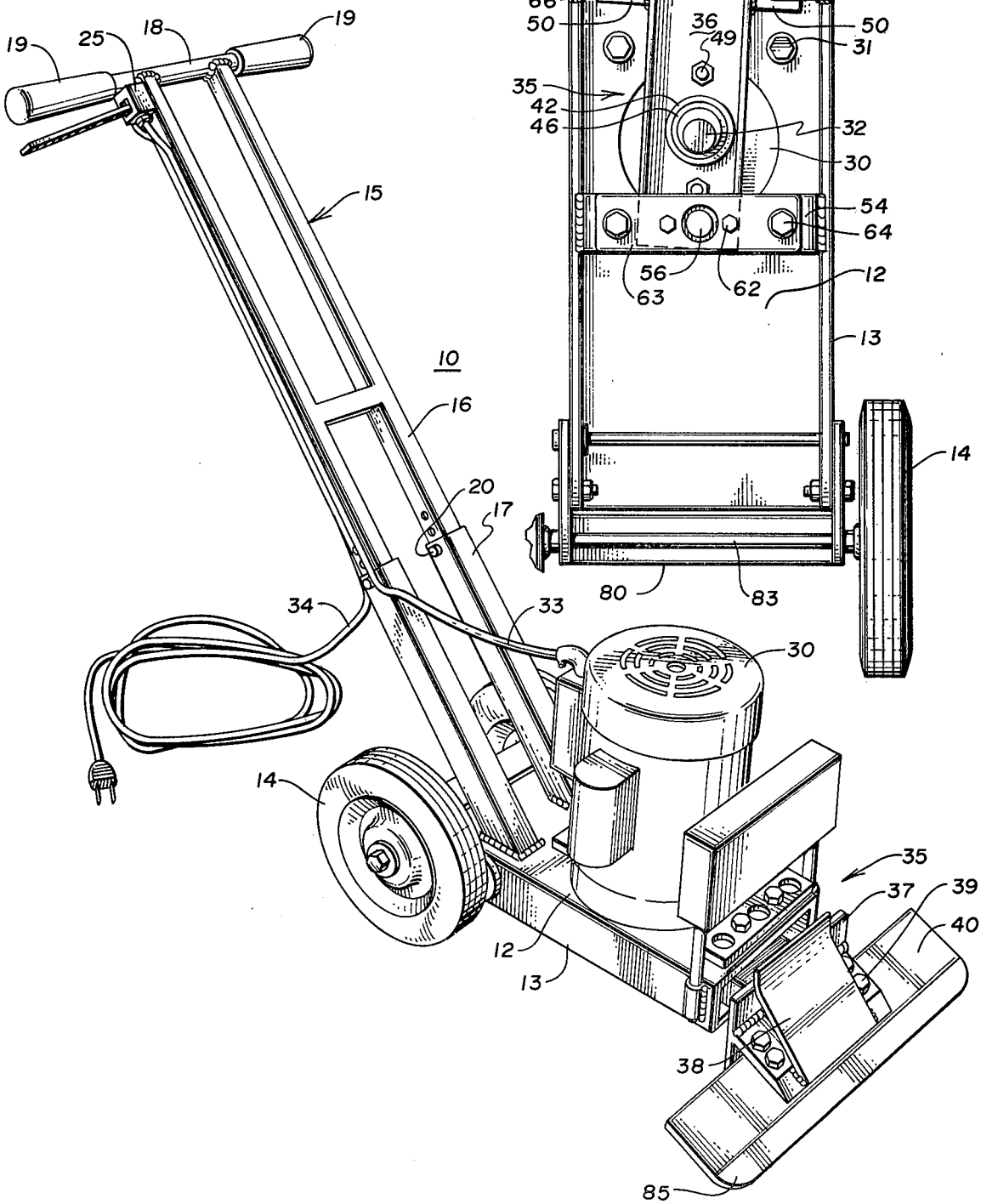
FIG. 1 is a perspective view of the machine embodying the invention.
Figures 3, 4, 5:
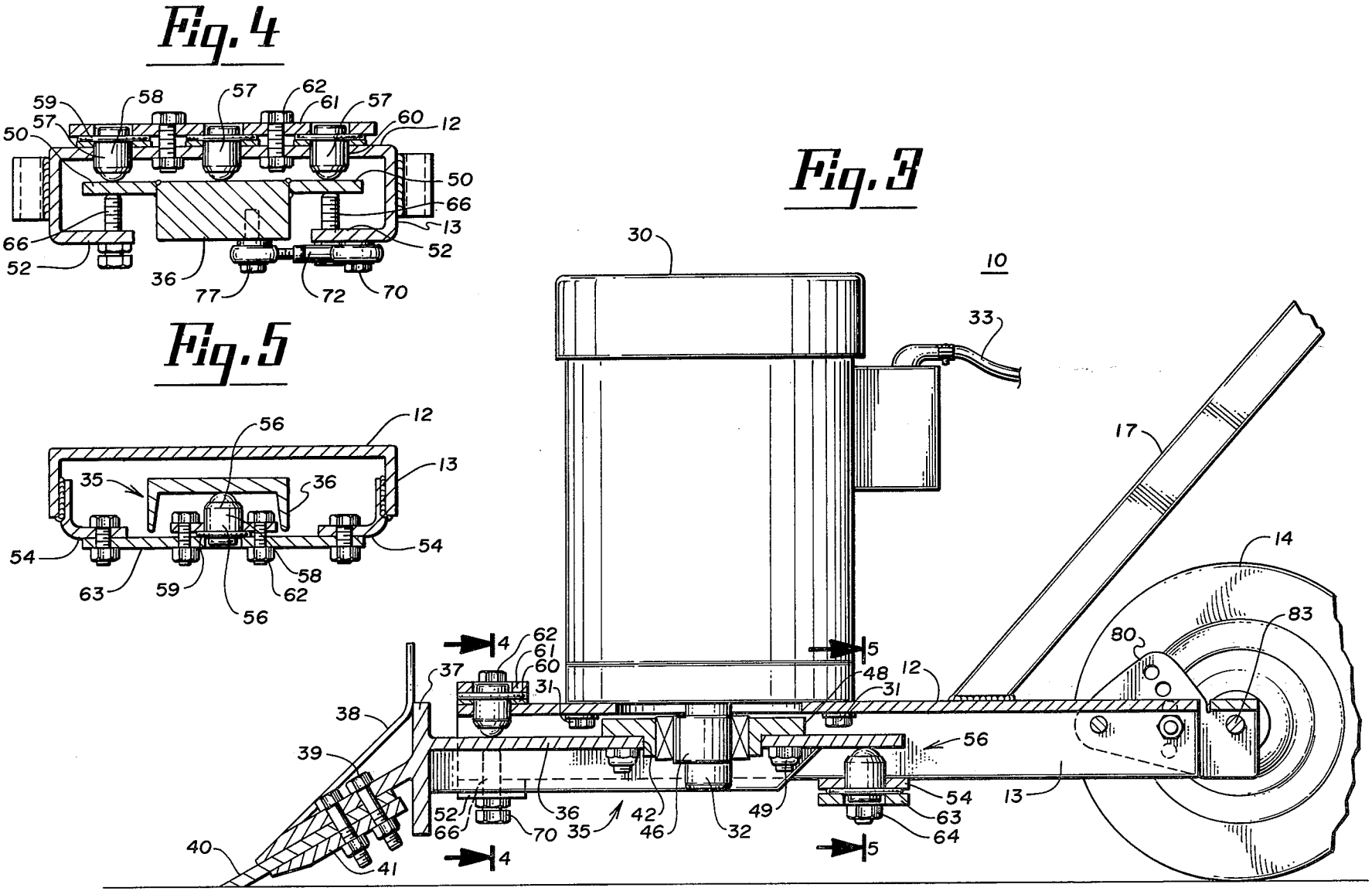
FIG. 3 is a side elevation view of the machine of FIG. 1 with portions cut away showing the relationship of internal moving parts.
FIG. 4 is a sectional view of FIG. 3 taken along the line 4—4 therein to show the mounting of the cutting blade mounting assembly; and, FIG. 5 is a sectional view of FIG. 3 taken along the line 5—5 therein.

The improved oscillating carpet and tile stripping machine is shown in perspective in FIG. 1 generally at 10. It includes a base or support frame 12 upon which a pair of wheels 14 are adjustably mounted on opposite sides of the base and adjacent the rear portion thereof. A handle member 15 is welded to the base 12 and extends rearwardly therefrom at an angle as shown terminating at the upper end thereof at a cross piece 18 which may be conveniently provided with suitable hand grip members 19. The handle 15 is a dual shaft unit formed in telescopic sections, as at 16, which slidably mount in fixed sections 17 welded to the frame 12. The sections 16 are held in position in the sections 17 by suitable pins 20. The telescopic sections and pins permit the length of the handle to be adjusted to an individual's workman's discretion.

Positioned on the handle is a suitable switch 25 which controls the energization of a motor 30 which is mounted on the frame 12 and suitably bolted thereon through bolt members 31. A shaft 32 of the motor extends through an opening in the frame and to the underside thereof to provide a driving mechanism to be hereinafter described. The motor 30 is connected by a suitable electric cord 33 leading to the switch 25 with a cord 34 leading from the switch and having a suitable male plug at the end of the same for insertion into a normal wall outlet. This provides for the application of electric power to motor 30. Switch 25 is positioned on the handle 15 adjacent one of the grip members and it includes an operating lever to permit the switch to be turned on and off by the operator as he grips the handle.

Figure 2:
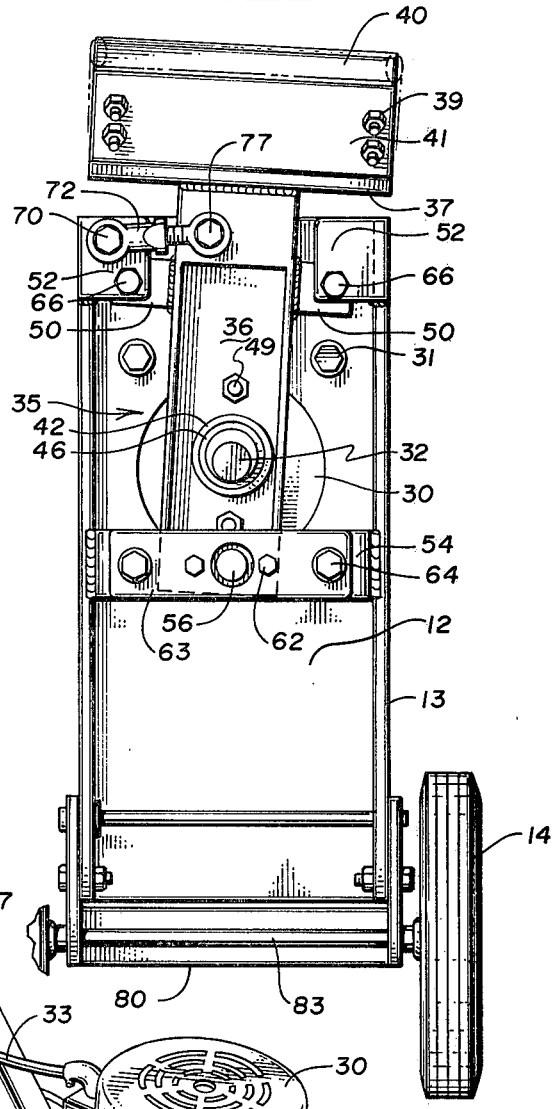
FIG. 2 is a bottom view of the drive mechanism of the machine of FIG. 1 with parts broken away.

The base or support frame 12 is generally channel shaped steel member with downwardly extending sides 13 which form a housing beneath the frame in which a portion of a blade mounting assembly 35 is positioned and connected to the motor. The blade mounting assembly includes an elongated drive bar portion 36 with a transversely extending blade mounting portion 37 at the end of the same in a generally "T" shaped structure. The drive bar portion 36 is positioned beneath the support frame and the blade mounting portion 37 is positioned transversely to and spaced from the end of the support frame 12 at the front of the machine. The blade mounting portion is designed to mount a cutting blade, indicated generally at 40, and a suitable plate member 41 is positioned at the opposite side of the blade to be connected to the blade mounting portion 37 by nuts and bolts 39 which clamp the blade 40 therebetween. The blade mounting portion has an inclined and bent tilt piece 38 suitably welded thereto which will aid in deflecting the floor covering material as it is removed from the floor. The blade 40 is moved in an orbital path such as is indicated by the dotted line in FIG. 2 showing generally the extent of motion. Motor 30 provides not only the driving force for the blade, but also provides the weight from the frame 12 to hold the blade 40 into positive engagement with the floor during operation of the machine and to provide an inertial mass by means of which the oscillating of the blade would be directed to the floor material. The elongated drive bar portion 36 of the blade mounting assembly is a generally channel shaped structure made of steel having a length extending from the motor shaft to the blade mounting portion 37 which is welded thereto. The blade mounting portion is formed of a plate member extending normal to the channel structure of the drive portion 36 with a forward plate welded thereto and inclined to position the blade 40. The channel member or elongated drive bar portion 36 has an aperture or opening 42 near the end of the same through which shaft 32 of motor 30 extends. The shaft is suitably secured by a key (not shown) to an eccentric member 46, the outer face of which is connected through a plate 48 to the elongated drive bar portion 36 by screws or nuts and bolts 49. The forward end of the drive bar portion 36 has flange members 50 welded thereon which project out from the edge of the same and within the confines of the sides 13 of the support frame 12. The bottom edges of the side walls directly beneath the flange members 50 have bracket members 52 welded thereon which are aligned with the flange members. At the middle of the frame 12, a second set set of brackets 54 are similarly mounted which project inwardly from the side walls 13 and below the drive bar member near the motor shaft and the eccentric member 46.

The elongated drive bar portion of the blade mounting assembly is journaled to the underside of the support frame 12 opposite the motor 30 through suitable spherical bearings indicated at 56 and 57. The spherical bearings are identical in construction and each are mounted in a bearing holder 58 having a suitable support plate 59 welded thereto with approximately half of a semi-spherical surface of the bearing being exposed in the holder 58. The plates supporting the bearing holders for bearings 57 are attached to the upper side of the frame 12 through suitable openings 60 therein and are suitably bolted thereto through a bar 61 and nuts and bolts 62. The bearings 57 are positioned at the forward end of the frame above the flanges 50 on the drive bar portion and above the drive bar portion at the center of the frame 12 adjacent the front end of the frame and the blade mounting portion 37 of the blade mounting assembly. The bearing 56 is located at the mid-point of the frame, contacting the rear end of the elongated drive bar on the underside thereof. It is mounted on a bar member 63 and secured thereto by nuts and bolts 62. Bar member 63 is secured to flanges 54 by nuts and bolts 64. The exposed surfaces of the bearings 56, 57 contact the main upper surface of the drive bar portion at the front of the same and on the flanges 50 attached thereto and the bottom of the drive bar portion at the other end thereof to support the blade mounting assembly within the frame 12 to guide the blade mounting assembly for oscillatory motion. It will be recognized that the blade mounting assembly is mechanically attached to the shaft of the motor and the bearings serve to space the drive bar portion of the blade mounting assembly from the support frame 12 and to journal the same thereon. The bearings 56 and 57 provide a triangular point support for the blade mounting assembly in its oscillatory movement. The brackets 52 at the front end of the frame mount guide bolts 66 which are positioned below the flanges 50 on the opposite side from the bearings 57. The bolts 66 are positioned adjacent the front end of the drive bar portion and the blade mounting frame portion 37 and serve to hold a blade mounting assembly at this end of the frame in a spaced relationship with the support frame when the machine is at rest. During operation of the motor 30, and with the machine in a working mode of operation, the force of the blade 40 against the floor and the weight of the motor on the frame will urge the blade mounting assembly 35 to ride on the bearings 56 and 57.

At the front of the frame 12 and on the underside thereof, one of the flanges 52 has an downwardly projecting pivot member 70 attached thereto. As will be best seen in FIG. 2, a suitable link 72 is connected to a journal on the pivot member, the link having a pivot surface at the opposite extremity to cooperate with a pivot member 77 bolted to the front end of the drive bar portion 36 of the blade mounting assembly. Link 72 is formed of two threaded parts which couple together to form the link which is adjustable in length by advancing or retracting one of the threaded parts into the other through the threaded coupling. The journaled link member 72 offsets the front end of the drive bar portion 36 of the blade mounting assembly relative to the frame 12. This amount of offset may be adjusted by changing the length of the link 72. The effect of the offset, which is in the direction opposite the direction of rotation of the motor and the eccentric, is such as to counteract the effect of centrifugal force of the motor on the frame 12 and, hence, the stripping machine. Without the offset and with normal eccentricity between the drive bar portion and the motor shaft, the machine has the tendency of moving in an arc, increasing the force required by the operator to hold it in a relatively straight line for a stripping operation. The journaled link member 72 also operates to restrict transverse movement of the blade mounting portion 37 welded to the drive bar portion and with the blade 40 thereon. However, the pivoted link allows for reciprocal movement of the drive bar portion 36 fore and aft of the frame through the action imparted by the eccentric. Thus, the oscillating path of the blade is not substantially restricted and the reduced effect of centrifugal force of the rotating motor and the transverse movement of the blade is such as to enable an operator to hold the machine in any desired position.

The angle of the blade mounting portion 37 which holds the blade 40, is such as to provide a desired angle for the blade in its engagement with the floor surface beneath the carpeting or floor covering material at the floor level. The wheels 14 at the rear of the frame are made adjustable through a pivoted linkage system 80 which allows the wheels to pivot relative to the frame for raising or lowering the rear end of the frame and hence, changing the angle of the blade mounting portion. A suitable lever member (not shown) connects to the shaft 83 and the pivoted link system for raising or lowering the wheels relative to the frame. When the frame is generally parallel with the floor lever, the angle of the blade mounting portion is about 30° to the floor in the cutting operation. The tip of the blade is beveled across the front surface and partially along the side surfaces as indicated at 85. The tip of the blade is self-sharpening in use and functions in an efficient manner to lift the carpeting or floor material from the floor. The metal back-up plate 41 extends across the width of the blade to stiffen the same and the curved plate 38 aids in starting the curve of the floor material as it is stripped or cut from the floor. The blade is suitably secured to the back-up plate 41 through the bolts 39 to the blade mounting portion so that it may be readily interchanged.

The action of the eccentric imparts an orbital or elliptical movement of the blade to provide a shearing action between the blade and the material being stripped for a more efficient stripping operation. With this arrangement of parts, the throw of the eccentric may be made relatively smaller to decrease the vibration imparted by the eccentric to the cutting blade assembly while substantially maintaining the size of the orbit or the translational movement of the blade. As an example, if the eccentric has a throw of about ⅛", the drive bar portion at the point of its connection to the motor moves through a reciprocal range of movement of about ¼" and side-by-side or transverse movement of ¼". By restricting the movement of the rear end of the blade mounting portion of the blade mounting assembly, the transverse movement of the blade of the cutting edge will be decreased to approximately 3/16" while retaining the range of reciprocal movement of about ¼". This increases significantly the ability to hold the machine steady or in a particular direction during a stripping or cutting action.

In the operation of the stripping machine, an operator places the machine so that the blade 40 is in engagement with the floor at the edge of the covering or floor material to be removed. The wheels are adjusted to a height for a desired cutting operation. The control panel switch is then turned on and the energization of the motor drives the eccentric to oscillate the blade mounting assembly. The motor shaft 32 to which the eccentric 46 is keyed drives the plate 42 attached to the drive bar portion of the blade mounting assembly to bring about the oscillatory motion of the blade mounting portion 37 of the blade mounting assembly. The motion imparted to the blade 40 will be in an orbital path. This will produce the desired shearing action beneath the carpeting. The operator need merely wheel the machine in a forward manner with the blade 40 in firm engagement with the floor to produce a rapid and efficient lifting of the carpet or floor material adjacent the blade from the floor. The arcuate or elliptical motion of the blade has a tendency to keep the blade sharp and thus advantageously decreases the number of blade changes required for extended use. The weight of the machine on the blade and the angle of the blade will cause the blade mounting assembly to be urged against the frame to be journaled on the bearings therein. At the front end of the frame the blade mounting assembly is journaled through the spherical bearing which contacts the elongated drive bar portion and its flanges with this end moving in an elliptical path. The rear of the drive bar portion is journaled on a spherical bearing for basically elliptical motion.

It will be recognized that various modifications may be made to the apparatus. For example, the ratio of the transverse motion to the reciprocating motion may be modified by changing the ratio of the distances between the restricted end of the drive bar portion and the cutting end thereof. The exact blade shape and supporting structure may be modified with different stiffening members. The connection of the drive bar portion to the eccentric may be varied, as well as the arrangement and shape of other parts.

Therefore in considering this invention, it should be remembered that the disclosure, while preferred at present, is illustrative and the scope of the invention should be determined by the appended claims.

What we claim is:

1. A carpet and tile stripping machine comprising: a support frame; motor means mounted on said frame; said motor means including eccentric means driven by said motor means to produce orbital motion in a substantially horizontal plane; handle means connected to the rear portion of said frame for guiding and maneuvering said carpet stripping machine; a cutting blade mounting assembly positioned on said frame for orbital movement in a substantially horizontal plane, said assembly having an elongated drive bar portion and a transversely extending cutting blade mounting portion; said elongated drive bar portion being operatively connected to said eccentric means with said cutting blade mounting portion being positioned beyond the front of said frame whereby the cutting blade portion is driven in an orbital, substantially horizontal path by said eccentric means; and means connected to the drive bar portion at the front end of the frame for restricting the movement of said bar portion at the front end of the frame to reduce the effect of centrifugal force on said blade mounting assembly.

2. The carpet and tile stripping machine of claim 1 in which the means connected to the front end of the drive bar portion is a pivoted link connected between the support frame and the drive bar portion.

3. The carpet and tile stripping machine of claim 1 in which the means connected to the bar portion at the front end of said frame is a link pivotally connected between the drive bar portion and the support frame, said link being adjustable in length to vary the angle between the draw bar portion and the support frame.

4. A carpet and tile stripping machine comprising: a support frame; motor means mounted on said frame; said motor means including eccentric means driven by said motor means to produce orbital motion in a substantially horizontal plane; handle means connected to the rear portion of said frame for guiding and maneuvering said carpet stripping machine; a cutting blade mounting assembly positioned on said frame for orbital movement in a substantially horizontal plane, said assembly having an elongated drive bar portion and a transversely extending cutting blade mounting portion; said elongated drive bar portion being operatively connected to said eccentric means with said cutting blade mounting portion being positioned beyond the front of said frame whereby the cutting blade portion is driven in an orbital, substantially horizontal path by said eccentric means; and means connected to the drive bar portion at the front end of the frame for restricting the movement of said bar portion at the front end of the frame to reduce the effect of centrifugal force on said blade mounting assembly, the machine including bearing means mounted on said frame and contacting the elongated drive bar portion of the cutting blade mounting assembly for spacing the elongated drive bar portion from the frame and guiding the same for its orbital movement.

5. The carpet and tile stripping machine of claim 4 in which the bearing means are spherical bearings.

6. The carpet and tile stripping machine of claim 5 in which the spherical bearings are mounted in bearing holders attached to the frame with semi-spherical bearing surfaces contacting the elongated drive bar portion.

7. The carpet and tile stripping machine of claim 6 in which the elongated drive bar portion of the cutting blade mounting assembly has guide flanges positioned between the eccentric means and the blade mounting portion and cooperating with certain of said spherical bearings.

8. The carpet and tile stripping machine of claim 7 in which the guide flanges extend transversely of the drive bar portion and cooperate with flange means positioned on the frame with guide bolts threaded therethrough and contacting the transversely extending guide flanges.

9. The carpet and tile stripping machine of claim 8 and including an additional flange member attached to the support frame under the elongated drive bar portion and near the end of the same for mounting an additional bearing means which contacts the drive bar portion.

10. The carpet and tile stripping machine of claim 9 in which the pivoted link is adjustable in length to vary the angle between the support frame and the drive bar portion of the cutting blade mounting assembly.

11. A carpet and tile stripping machine comprising: a support frame; motor means mounted on said frame; said motor means including eccentric means driven by said motor means to produce orbital motion in a substantially horizontal plane, said eccentric means being positioned on a surface of the frame opposite said motor means; a pair of wheels rotatably mounted on the rear portion of said frame; handle means connected to the portion of said frame for guiding and maneuvering said carpet stripping machine; a cutting blade mounting assembly positioned on said frame for orbital movement in a substantially horizontal plane, said assembly having an elongated drive bar portion and a transversely extending cutting blade mounting portion; said elongated drive bar portion being connected to said eccentric means with said cutting blade mounting portion being positioned beyond the front of said frame whereby the cutting blade portion is driven in an orbital substantially horizontal path by said eccentric means; and pivoted link means connected to the drive bar portion at the front end of the frame for restricting the movement of said bar portion at the front end of the frame to reduce the effect of centrifugal force on said blade mounting assembly.

12. The carpet and tile stripping machine of claim 11 in which the pivoted link means has bearing members at either end of the same connecting the pivoted link to the support frame and the drive bar portion.

13. The carpet and tile stripping machine of claim 11 in which a pair of wheels are adjustably mounted in the frame to change the angle of contact of the cutting blade mounting portion with the surface on which the machine is positioned.

14. A carpet and tile stripping machine comprising: a support frame; motor means mounted on said frame; said motor means including eccentric means driven by said motor means to produce orbital motion in a substantially horizontal plane, said eccentric means being positioned on a surface of the frame opposite said motor means; a pair of wheels rotatably mounted on the rear portion of said frame; handle means connected to the portion of said frame for guiding and maneuvering said carpet stripping machine; a cutting blade mounting assembly positioned on said frame for orbital movement in a substantially horizontal plane, said assembly having an elongated drive bar portion and a transversely extending cutting blade mounting portion; said elongated drive bar portion being connected to said eccentric means with said cutting blade mounting portion being positioned beyond the front of said frame whereby the cutting blade portion is driven in an orbital substantially horizontal path by said eccentric means; and pivoted link means connected to the drive bar portion at the front end of the frame for restricting the movement of said bar portion at the front end of the frame to reduce the effect of centrifugal force on said blade mounting assembly, the machine including triangular spaced bearing means mounted on said frame and contacting the elongated drive bar portion to space the same from said frame and guide the cutting blade mounting assembly in its movement.

* * * * *